US005385123A

United States Patent [19]

Evans

[11] Patent Number: 5,385,123

[45] Date of Patent: Jan. 31, 1995

[54] SEGREGATED COOLING CHAMBERS FOR AQUEOUS REVERSE-FLOW ENGINE COOLING SYSTEMS

[76] Inventor: John W. Evans, 253 Rte. 41 N., Sharon, Conn. 06069

[21] Appl. No.: 134,212

[22] Filed: Oct. 8, 1993

[51] Int. Cl.[6] ..... F01P 9/02

[52] U.S. Cl. ..... 123/41.21; 123/41.54

[58] Field of Search ..... 123/41.01, 41.1, 41.2, 123/41.21, 41.22, 41.23, 41.27, 41.29, 41.54, 41.74, 41.82 R

[56] References Cited

U.S. PATENT DOCUMENTS 5,255,636 10/1993 Evans ..... 123/41.54

*Primary Examiner*—Noah P. Kamen
*Attorney, Agent, or Firm*—Lyman R. Lyon

[57] ABSTRACT

A reverse-flow cooling system for an internal combustion engine uses an aqueous, boilable liquid coolant, having a saturation temperature at least equal to water. The engine is provided with discrete combustion chamber and cylinder bore cooling chambers that are cooled by a coolant pumped from a heat exchanger first to the combustion chamber cooling chamber, thence to the cylinder bore cooling chamber. Gases found in the combustion chamber cooling chamber are condensed in a condenser and then returned to a relatively low pressure area of the cooling circuit.

9 Claims, 4 Drawing Sheets

SEGREGATED COOLING CHAMBERS FOR AQUEOUS REVERSE-FLOW ENGINE COOLING SYSTEMS

BACKGROUND OF THE INVENTION

When aqueous reverse flow cooling is employed in an internal combustion engine, as disclosed in my co-pending application Ser. No. 907,392, it may be desirable to draw coolant directly from one of the engine coolant chambers into the pump and then subsequently force coolant by positive action of the pump to other engine cooling chambers or, alternately, directly to the radiator. Additionally, it may at times be desirable to select certain regions of the engine's cooling chambers for primary cooling, thereby assuring that those selected regions will always operate at a lower temperature than most other regions of the engine's head and block cooling chambers. This is important during critical cooling periods for the engine such as high ambient or high load conditions. Lastly, when employing the aqueous reverse flow cooling system described in my copending application Ser. No. 907,392, it is often desirable, in order to achieve maximum cooling efficiency when either constructing the pump to draw coolant directly from one of the engine cooling chambers or drawing first from the radiator and then passing the coolant to the cylinder head combustion chamber cooling area, to dedicate substantially all flow through only one coolant region of the cylinder head coolant chamber. With such dedicated coolant flow, there is little or no communication with other cooling chamber regions of the cylinder head or block coolant chambers until after substantially all the coolant has first flowed through the dedicated region.

If a coolant pump is configured to draw coolant directly from one of the coolant chambers of an engine as described in my co-pending application Ser. No. 907,392, a severe limitation is placed upon the maximum temperature level at which the coolant can be allowed to operate because some coolant vapor generated in the cylinder head cooling chamber during periods of high coolant heat and load will pass downwardly through the cylinder block cooling chamber by action of the pump's draw (vacuum) and enter into the impeller cavity area of the pump. Impeller cavitation substantially reduces pumping efficiency or, in some instances, may stop the pump completely. Even though the natural buoyancy of the coolant vapor causes most of the vapor to rise and be moved by the vapor circuitry, as disclosed in said co-pending application Ser. No. 907,392, some vapor will be inevitably drawn to the pump. This condition is aggravated when the pump is mounted directly to the cylinder block because of direct communication between the pump and the cylinder block coolant chamber. Additionally the greater the horizontal distance between the vapor take-off point of the cylinder head cooling chamber and the attachment point of the pump to the cylinder block cooling chamber, the greater the draw upon the vapor existing vertically above the pump attachment point and resulting in a greater amount of vapor being drawn into the pump.

When, in some instances, in order to facilitate ease of mounting and engine design, the pump drawside (pump vacuum) attachment point is moved towards to the cylinder head cooling chamber area whereby the pump will draw coolant directly from the head cooling chambers and subsequently force coolant to the cylinder block cooling chambers, the problem of drawing hot coolant vapor into the pump becomes more problematic during periods of higher coolant temperatures caused by high ambients and engine loads. The vacuum draw acting directly upon the coolant residing around the hotter combustion dome areas (spark plugs, exhaust valves, and runners in the cooling chamber will draw coolant vapor, as generated, directly into the impeller area and eye of the pump, reducing pump efficiency.

When employing aqueous reverse-flow cooling, as in my co-pending application Ser. No. 907,392, the use of a single cylinder head coolant chamber with multiple transfer ports to the cylinder block coolant chambers often causes a distribution imbalance whereby it is difficult to achieve an even flow volume distribution across the engine cross sectional area of the cooling chamber, especially in areas most distant from the coolant inlet. Also the use of a single cooling chamber for the cylinder head combustion chamber area of the engine does not allow for the design of the head cooling circuit to set a different coolant operating temperature level for one area of the cylinder head as opposed to a distinctly separate area but common to the same cooling chamber area, i.e., exhaust area versus intake area of the same cylinder head cooling chamber.

SUMMARY OF THE INVENTION

The aforesaid problems experienced in attempting to draw coolant directly from one of the engine coolant chambers into the coolant pump, or in operating selected regions of the cylinder head cooling chamber at different temperature levels with an aqueous reverse-flow cooling system, are solved in accordance with constructed embodiments of the instant invention, by a unique engine cylinder head, block, pump and thermostat, and placement thereof within the coolant circuitry. Dedicated coolant flow patterns along with individual segmentation of either complete cooling chambers, or a region within an individual cooling chamber facilitate the operation of selected areas of the cylinder head combustion chambers at preferred temperature levels and allow for the isolation of vapor from the inlet of pump when the pump draws directly upon one of the engine cooling chambers. Unique placement of the pump at either the inlet to, at the approximate midpoint of, or at the outlet of a reverse-flow adapted cylinder block, cylinder head, and thermostat are used to balance coolant flow, temperature gradients, and control coolant vapor within the circuitry of an aqueous reverse-flow cooling system.

Lastly, alternate embodiments of the invention allow for the segmented operation of the cylinder head cooling chamber area whereby one or more selected regions of the cylinder head cooling chamber may be operated at different predetermined coolant temperature levels. Thus, selected regions remain substantially free of coolant vapor while other regions are able to continue to produce normal volumes of coolant vapor. These alternate embodiments also allow for bi-directional coolant flow, whereby coolant flow in one or more of the segmented regions of the cylinder head chamber is in the reverse-flow direction while coolant flow in the remaining cooling chambers in the conventional flow direction.

BRIEF DESCRIPTION OF THE DRAWINGS

FIG. 3 is a schematic of another embodiment of the present invention wherein segmented regions of the cylinder head cooling chamber area each produce vapor.

DETAILED DESCRIPTION OF THE PREFERRED EMBODIMENT(S)

Figure 1:
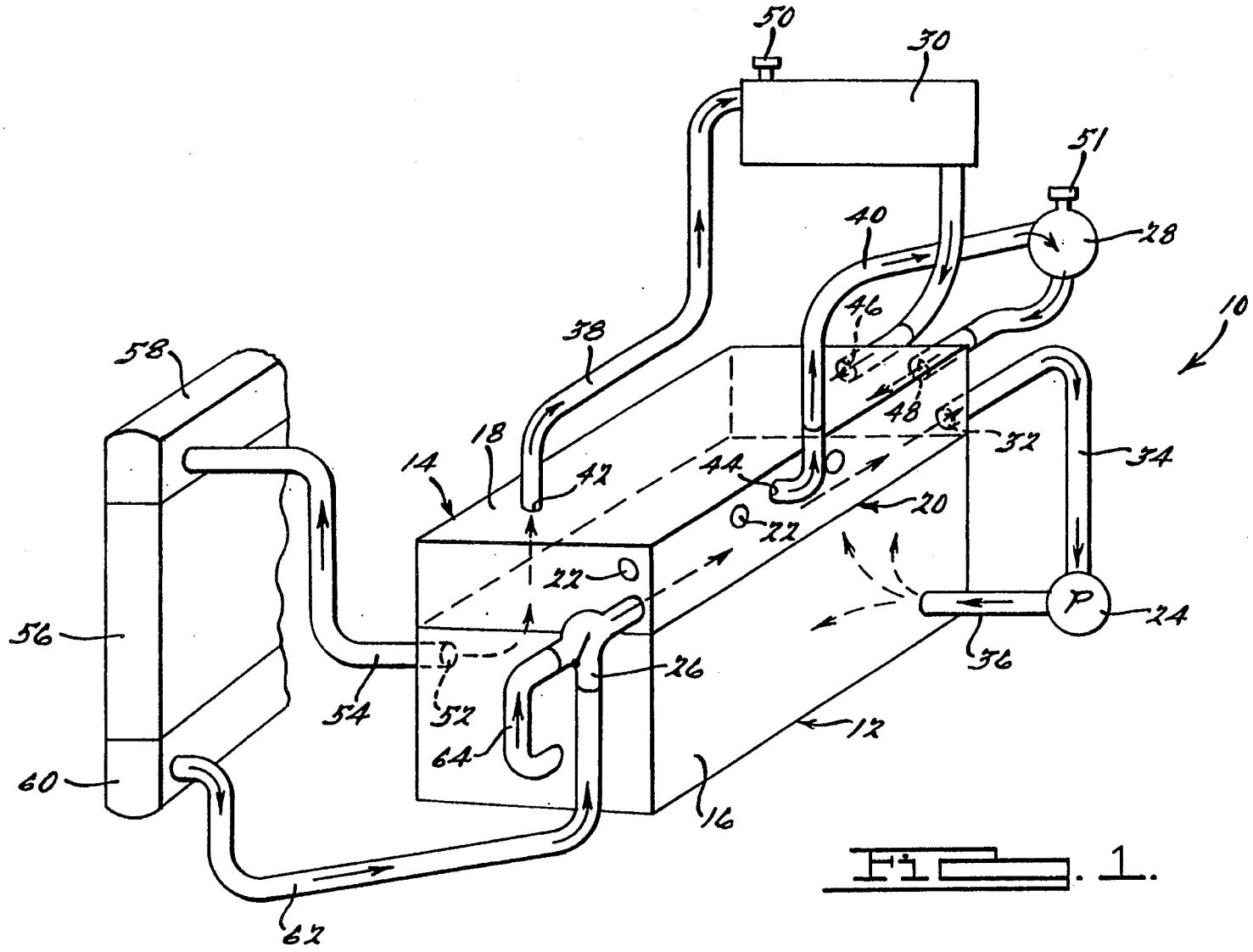
FIG. 1 is a schematic view of the cooling system of the present invention employing a pump utilizing draw-through coolant action, segmentation of the entire cylinder head cooling chamber area, and the vapor circuitry of my co-pending application.

As seen in FIG. 1, an internal combustion engine embodying the cooling system of the present invention is indicated generally by the reference numeral 10. The engine 10 is hereinafter described with reference to a motor vehicle (not shown), but can be used in other applications. The engine 10 comprises an engine cylinder block 12 and an engine cylinder head 14. A block cooling chamber area 16 is filled with an aqueous coolant, as described in my co-pending application Ser. No. 907,392, and accommodates coolant flow therethrough to cool the metal surfaces of the engine 10. A cylinder head cooling chamber 18 is also filled with coolant and accommodates coolant flow therethrough to cool this portion of the engine 10. A solid head gasket 20 substantially completely blocks any communication between the head coolant chamber area 18 and the block coolant chamber area 16. Alternately strategically placed and aligned relatively small transfer ports 22 may be inserted in the head 14, block 12, and gasket 20 in order to allow for passage of entrapped air during system fill, and to pass small amounts of vapor at areas of nucleate boiling. A coolant pump 24 and a thermostat 26 are employed to cause coolant to be drawn through the cylinder head coolant chamber 18. One or more gas separator/condenser circuits 28 and 30 are employed, as disclosed in my co-pending application Ser. No. 907,392, which serve the dual purpose of a throttle body and heater core, respectively.

In accordance with the present invention engine coolant flows from the head coolant chamber 18 out of coolant port 32 through conduit 34 into the drawside of pump 24 by action of the pump's impeller and the vacuum created thereby. The pump 24 forces coolant out through conduit 36 into block cooling chamber 16. The coolant flow is therefore in the reverse direction from conventional cooling systems. Coolant cannot pass between the head chamber 18 and the block chamber 16 except by way of either the pump 24, the thermostat 26, or the small transfer ports 22 because of the segregation of the two chambers caused by the solid head gasket 20. The transfer ports 22 are typically the only communication between the head chamber 18 and the block chamber 16 and are small in size, usually less than one percent of the total cross-sectional block coolant chamber 16 area. The ports 22 are sized to have minimum effect on total coolant flow, as they will essentially create a short circuit between the head chamber 18 and the block chamber 16. The transfer ports 22 function solely to allow entrapped air to pass between the block chamber 16 and head chamber 18 during filling of the system and vapor generated in the block chamber 16 to pass at the relatively small vapor nucleate points or during periods of engine shutoff immediately after high coolant temperature or engine load. The vapor passes upwardly through the gasket 20, the head chamber 18 and out of the head 14 through the vapor vent circuits by way of either vent conduit 38 or 40 to the vapor condensers as depicted as the throttle body 28 and heater core 30. During operating periods of normal engine operation the above-mentioned vapor circuits function similarly to the gas separator/condenser circuitry as disclosed in my co-pending application Ser. No. 907,392. By selectively placing the connections of vapor circuitry conduits 38 and 40 a desired differential can be created across outlet ports 42 and 44 and inlet ports 46 and 48, respectively. Coolant flow can be established which will cause coolant to flow through the heater core 30 or the throttle body 28 (if used) which allows them to function for both the exchange of heat and the condensation of vapor which has passed out of the cylinder head chamber 18. If increased flow is required, the outlet ports 46 and 48 may be attached to the lower pressure conduit 34, and conversely should excessive flow occur, then a line restriction may be placed at any point in the circuit. Similarly a single purpose gas separator/condenser tank can be employed, as described in my co-pending application Ser. No. 907,392, which would function with, or in place of, the heater core 30 and the throttle body 28. However, both the heater core 30 and throttle body 28 make excellent condensers because of the amount of BTU's exchanged incident to function of the units.

Small amounts of noncondensible gases which may occur within the cylinder head cooling chamber 18 will pass through the vapor circuit exiting through head ports 46 or 48 and will subsequently be drawn into head outlet port 32, thence through conduit 34 to pump 24, through conduit 36 into the block cooling chamber 16. Any noncondensible gases which remain in either the heater core 30 or throttle body 28 can be released through manual bleeds 50 and 51 respectively, or alternately, such noncondensible bleeds may be constructed as a continuous bleed as described in my nonaqueous engine cooling system U.S. Pat. No. 5,031,579 wherein bleed-off of trapped air is achieved by connection to the low pressure side of an aqueous pressurized reverse-flow cooling system.

As long as only small amounts of trapped air or noncondensible gases pass through the pump 24 (typically much less than vapor volumes encountered), they will have no effect on pump efficiency. However, if the volume of noncondensible gases are excessive, then a continuous bleed will be required. Such bleed systems are typical on many of the conventional cooling systems currently in use.

Coolant passes from the head chamber 18 into block chamber 16 by action of the pump 24, thence out of the block chamber 16 through outlet port 52 into conduit 54 carrying with it any noncondensible gases which have accumulated in the block coolant chamber 16. It is preferred to place the outlet port 52 at an uppermost point in the block coolant chamber 16 in order to facilitate the rapid movement of gases out of the chamber 16. Additionally, any coolant vapor generated in the block coolant chamber 16, typically around the top two inches of the cylinder bores (not shown), will be passed out with the coolant in the same manner as the noncondensible gases. Conduit 54 will then pass coolant, vapor and noncondensible gases into the radiator 56 in which the gases will remain in the upper most area, shown as a top-tank 58, until reduced to liquid, or exhausted out a conventional-type radiator vent system (not shown). Coolant under pressure by action of the pump 24 will pass out of the radiator 56 through a bottom tank 60, through a conduit 62 and be returned back to the head coolant chamber 18 through the proportional thermostat 26. During warm-up of the engine 10, conduit 62 is blocked by action of the thermostat 26 and coolant is drawn completely, at first, from conduit 64 in order to facilitate warm-up and to continuously move a high volume of coolant through the cylinder head coolant chamber 18 in order to lower the amount of vapor existing therein by increased action of the coolant upon the vapor (greater level of heat exchange with vapor and increased subcooling by the liquid). Such flow improves conditioning of the critical metal temperatures, and increases coolant turbulence, features disclosed in my co-pending thermostat application Ser. No. 947,144. After warm-up, the thermostat 26 will cycle between conduits 62 and 64 and continue to function as disclosed in my co-pending application Ser. No. 947,144. The action of coolant passing through the head coolant chamber 18 is further improved, by the coolant chamber segregation created by the substantially solid head gasket 20 of the present invention. Such segregation causes substantially all the coolant entering the head coolant chamber 18 through thermostat 26 to pass through the head coolant chamber 18 before passing into the block cooling chamber 16. In the preferred embodiment of this configuration it is most desirable to balance flow through the vapor circuit, as shown, by returning the coolant through ports 46 and 48 into the head chamber 8 thereby making certain that substantially all the coolant which enters the head chamber 18 from thermostat 26 passes totally through the chamber 18 and that a maximum amount of vapor reduction is achieved and that increased turbulence is maintained to sweep the vapor off the internal metal surfaces.

If the conditions which are described above for this embodiment are not met and there is excessive communication of coolant between the head coolant chamber 18 and the block coolant chamber 16, then coolant velocity will be slowed in some areas of head chamber 18, heat exchange and turbulence will be reduced in those areas and an excessive amount of vapor will be generated during periods of high coolant temperature and engine loads. Excessive vapor volumes persisting within head chamber 18 will result in an overwhelming of the vapor circuitry and a substantial reduction in the ability of the condenser (heater 30 or throttle body 28) to reduce vapor to liquid, resulting eventually in too much coolant being displaced from the head chamber 18. Vapor will then exit the head through port 32 and then enter the pump 24 reducing its pumping efficiency whereby the coolant flow rate is lowered which reduces the exchange of heat in the cylinder head coolant chamber 18. The lowered exchange of heat causes the engine metals to run hotter, hence more vapor produced, and the reduction of vapor to liquid to be reduced, hence more vapor persists. Therefore, the cycle worsens causing excessive critical engine metal temperatures resulting in pre-ignition, detonation, metal cracking, head gasket failure, and ultimately total system and engine failure.

Thus, it can be clearly seen that it is necessary to coordinate the cylinder head 14, cylinder block 12, gasket 20, pump 24, thermostat 26, and condenser circuits 30 and 28 into cooling circuits with dedicated flow patterns thereby controlling and directing proper aqueous reverse-flow coolant flow volume.

As an alternate to the aforesaid embodiment of the present invention, the pump 24 can be moved from its location between conduits 34 and 36, and be relocated to reside in conduit 54 or at port 52. All other components would remain as shown and the system would function as disclosed with the exception that conduit 34 and 36 would become a single conduit with continuous flow and cylinder block coolant chamber 16 would change from operating in direct communication with the positive pressure side of the coolant pump 24 to communication with the negative pressure (vacuum) side thereof caused by the drawside of the pump communicating directly with cylinder block chamber 16.

Figure 2:
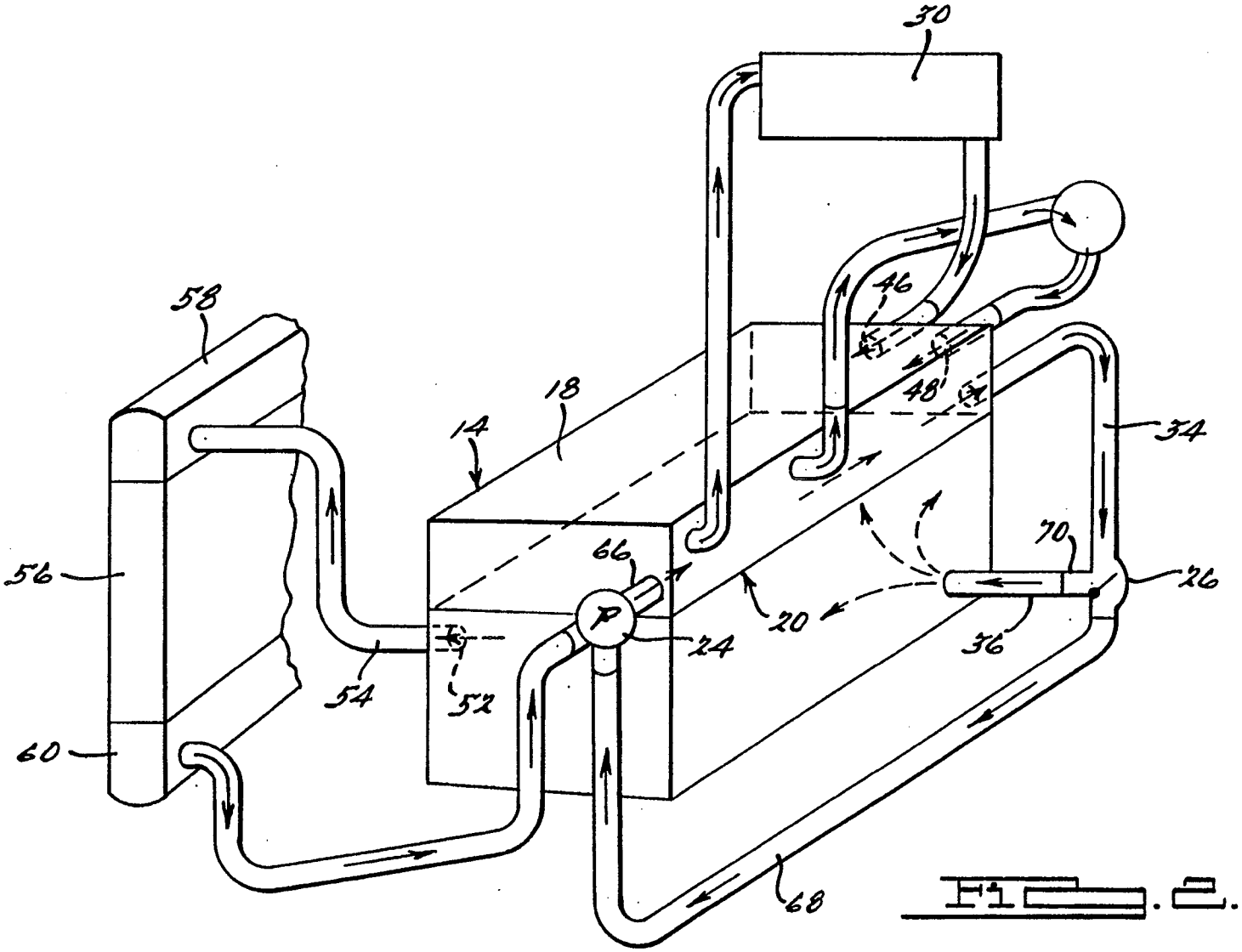
FIG. 2 is a schematic of a variation of the system of FIG. 1 modified to operate with a pump utilizing push-through coolant action.
Figure 2:
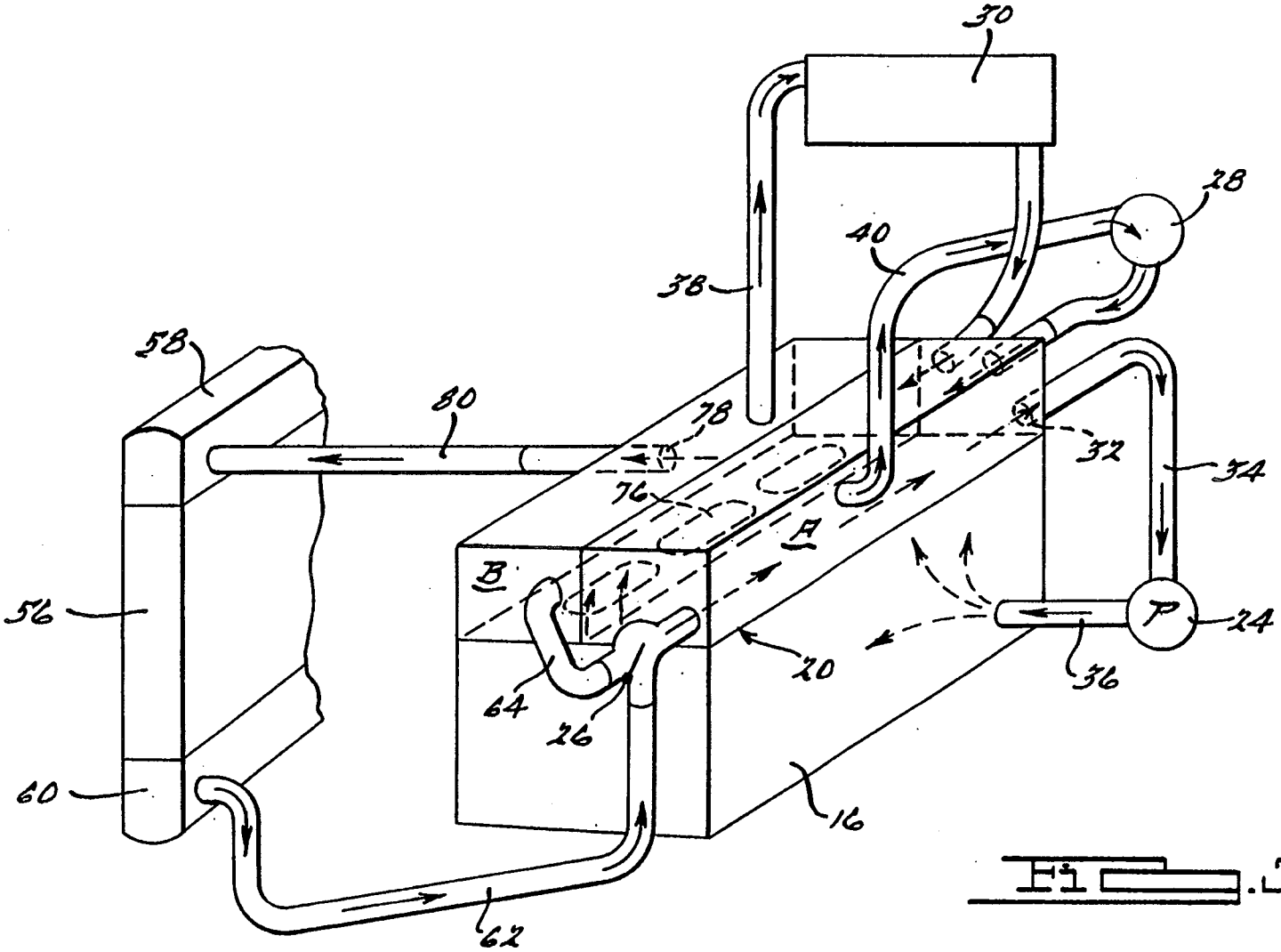

FIG. 2 illustrates another embodiment of the cooling system of the present invention. The engine 10 is substantially the same as the engine described in relation to FIG. 1 and, therefore, like reference numerals are used to indicate like elements. The system of FIG. 2 differs from the system of FIG. 1 in that the coolant pump 24 is moved to the inlet side of the cylinder head coolant chamber 18 and therefore will push coolant into the chamber 18, through inlet port 66, and out through the outlet port 32, by action of the positive pressure exerted on the coolant by pump 24. The proportional thermostat 26 is moved to the outlet side of cylinder head chamber 18 and is constructed to receive all the coolant which flows out of the outlet port 32. During warm-up, the thermostat 26 passes all the coolant received from port 32 back to the pump 24 by way of a bypass conduit 68. During the initial warm-up thermostat 26 will positively close conduit 36 stopping any coolant flow to the cylinder block chamber 16 outlet port 52, conduit 54 and radiator 56. As the engine and coolant increase in temperature, the thermostat 26 will gradually reduce flow through the bypass conduit 68 and increase flow through conduit 36 into the block chamber 16 until, when at its full open setting, all coolant will flow through conduit 36 and the bypass 68 will be completely shut off. As flow increases through conduit 36 into chamber 16, the flow also increases out of the outlet port 52 to the inlet tank 58 of radiator 56 where it exchanges heat from the coolant to the ambient air, and returns coolant, lowered in temperature, from the outlet tank 60 to the inlet/drawside of pump 24. Coolant is then returned to the cylinder head chamber 18. The outlet ports 42 and 44 for the condenser circuit (shown as heater 30 and throttle body 28), respectively, are placed as described for the engine 10 of FIG. 1, but would typically be subjected to a higher pressure level of coolant due to the positive pressure exerted upon the coolant in chamber 18 by the pump's positive action through port 66. Flow balancing of the outlet ports 42 and 44 to the inlet ports 46 and 48 would be accomplished as described in FIG. 1.

In the operation of this embodiment of the present invention, the cylinder head coolant chamber 18 rises in temperature at an increased rate because cylinder head coolant which has passed through the head chamber 18 is immediately returned to the coolant pump 24 and head chamber 18 without being mixed with the coolant from block chamber 16 which is lower in temperature and which, by increasing the bulk of the coolant during initial warm-up, would significantly slow the warm-up rate. Head chamber 18 coolant would only start to slowly "blend" with block chamber 16 coolant after the head chamber 18 coolant is at or close to the full temperature setting of the thermostat 26. The rapid warm-up rate is also accomplished while still maintaining the preferred higher flow rates as described in my co-pending applications. This is especially important during the period which exists before the thermostat 26 internal valve starts to open and the coolant is close to full operating temperature (termed "cracking thermostat point"). During such periods the areas of critical metal temperature in the head chamber 18 have reached a level at which insufficient coolant flow can cause heat stress, detonation, preignition and metal cracking.

An additional advantage of flowing coolant through the head chamber only during warm-up is the availability of hot coolant to the heater 30 and throttle body 28, if used, in a shorter amount of time. This is an especially desirable feature for vehicles which operate in colder ambients where a faster rise in passenger compartment heat is an advantage.

If, when using the engine 10 configuration of FIG. 2 where the pump 24 is mounted as shown on the inlet side of the head coolant chamber 18, coolant flow is desired through the block coolant chamber 16 during warm-up, the proportional thermostat 26 need merely be moved to reside in between conduits 54 and 62 with the full flow port 70 connected directly to the inlet side of pump 24 thereby eliminating conduit 68 completely and joining conduit 34 and 36 into one full flow conduit between the head chamber 18 and the block chamber 16. In operation the coolant pump 24 effects substantially full flow of coolant through the coolant chamber 18, obtaining all the benefits of the present invention and the preferred features of my two co-pending applications, before passing coolant on to the block coolant chamber 16. When the thermostat 26 is placed between conduits 54 and 62 it will close communication with conduit 62 during warm-up, stopping any flow through radiator 56, allowing all the coolant exiting port 52 to return to the head chamber 18 by action of pump 24. Upon reaching the preset thermostat 26 "cracking point," the thermostat will blend and cycle coolant as described above.

FIG. 3 is yet another embodiment of the cooling system of the present invention that is constructed with segregation of only a region of the engine cylinder head cooling chamber area. The engine 10 is substantially the same as the engine described above in relation to FIGS. 1 and 2 and, therefore, like reference numerals are used to indicate like elements. The engine 10 of FIG. 3 differs from the engine described above in that it employs cooling chamber segregation of the intake and exhaust region 72 of the cylinder head cooling chamber. Segregation of the head coolant chamber regions into areas "A" and "B" as shown in FIG. 3, will effect a bidirectional coolant flow in the cylinder head 14 of engine 10. Specifically, coolant will flow in the reverse direction by first entering the cylinder head intake coolant chamber region "A" then pass, still in the reverse direction, to the cylinder block coolant chamber 16 and finally pass upwardly, in the conventional flow direction, through and out of the cylinder head exhaust side coolant chamber "B." In the embodiment of FIG. 3 cylinder head 14 coolant operates at a temperature level whereby the volume of vapor generated in the segregated region is beyond the ability of the coolant to subcool the vapor and vapor/separator circuitry as described in my co-pending application Ser. No. 907,392 is required.

In operation the drawside of the coolant pump 24 acts upon conduit 34 and draws coolant into the intake coolant chamber "A" by way of the proportional thermostat 26 which functions in the same manner as described above in FIGS. 1 and 2. The segregated intake chamber area "A" is substantially blocked from communication with the cylinder block chamber 16 by the solid head gasket 20, except for the extremely small gas transfer ports as described above with respect to FIGS. 1 and 2. Therefore, substantially all the coolant which enters the intake chamber "A" inlet 66 will pass through the chamber "A" side of head 14 and out port 32. The pump 24 will force coolant downwardly through conduit 36 and into the cylinder block chamber 16 from where it will pass upwardly through much larger full-flow ports 76 in the portion of the head gasket 20 which seals the exhaust coolant chamber area "B" from the intake chamber "A" in the conventional flow direction, through the coolant outlet port 78. Coolant passing up and out of the exhaust chamber "B" will carry with it any coolant vapor or gases that have accumulated in the exhaust chamber "B," passing them on through conduit 80 to the top tank 58 of radiator 56 where they will remain at the top until reduced to liquid or removed by subsequent venting typical to conventional cooling systems in current use. Thus the exhaust chamber "B" remains substantially free of vapor and gases. Additionally, a condenser circuit, shown as the heater 30, may be employed for further action upon vapor generated within the exhaust chamber "B" and when placed at such location will achieve maximum heater 30 performance and reduced heater 30 warm-up delay time as opposed to attachment at "A."

Segregation of the intake chamber area "A" from the exhaust chamber "B" and the block chamber 16, whereby the lowest temperature coolant enters and completely passes through the intake chamber "A" permits the chamber "A" to be operated at a predetermined temperature which is substantially lower than the exhaust side chamber "B" of the cylinder head 14. Thereby the fuel intake charge runners and valves are operated at a lower and more optimum temperature, reducing, detonation, preignition, brake specific fuel consumption (BSFC) and volume of vapor produced. Warm-up of the intake charge from cold start is also enhanced by the proportional thermostat 26 bypass conduit 64 drawing directly from the exhaust chamber area "B."

A vapor circuit, as disclosed in my co-pending application, shown as a throttle body heater 28, is employed as described above in FIGS. 1 and 2 and is connected to intake chamber "A" by line 40. Coolant is returned to the lower pressure side of chamber "A" at outlet port 48 or alternately to conduit 34 if a higher draw from pump 24 is required.

Alternately, the coolant pump 24 may be moved to the inlet side of the intake chamber area "A." The intake chamber "A" will then operate under positive pressure from the outlet side of pump 24 and the thermostat 26 with connecting conduits 34 and 36 joined and in common will function as a "push-through" coolant system as described above with respect to FIG. 2.

Entrapped air and other noncondensible gases in this embodiment of the present invention are passed through the segregated intake chamber area "A" by action of the velocity of the coolant. If the volume of the noncondensible gases is excessive, manual or constant bleed devices, as described above in FIG. 1, would need to be employed on components such as the high points of condensers 30 and 28.

Figure 4:
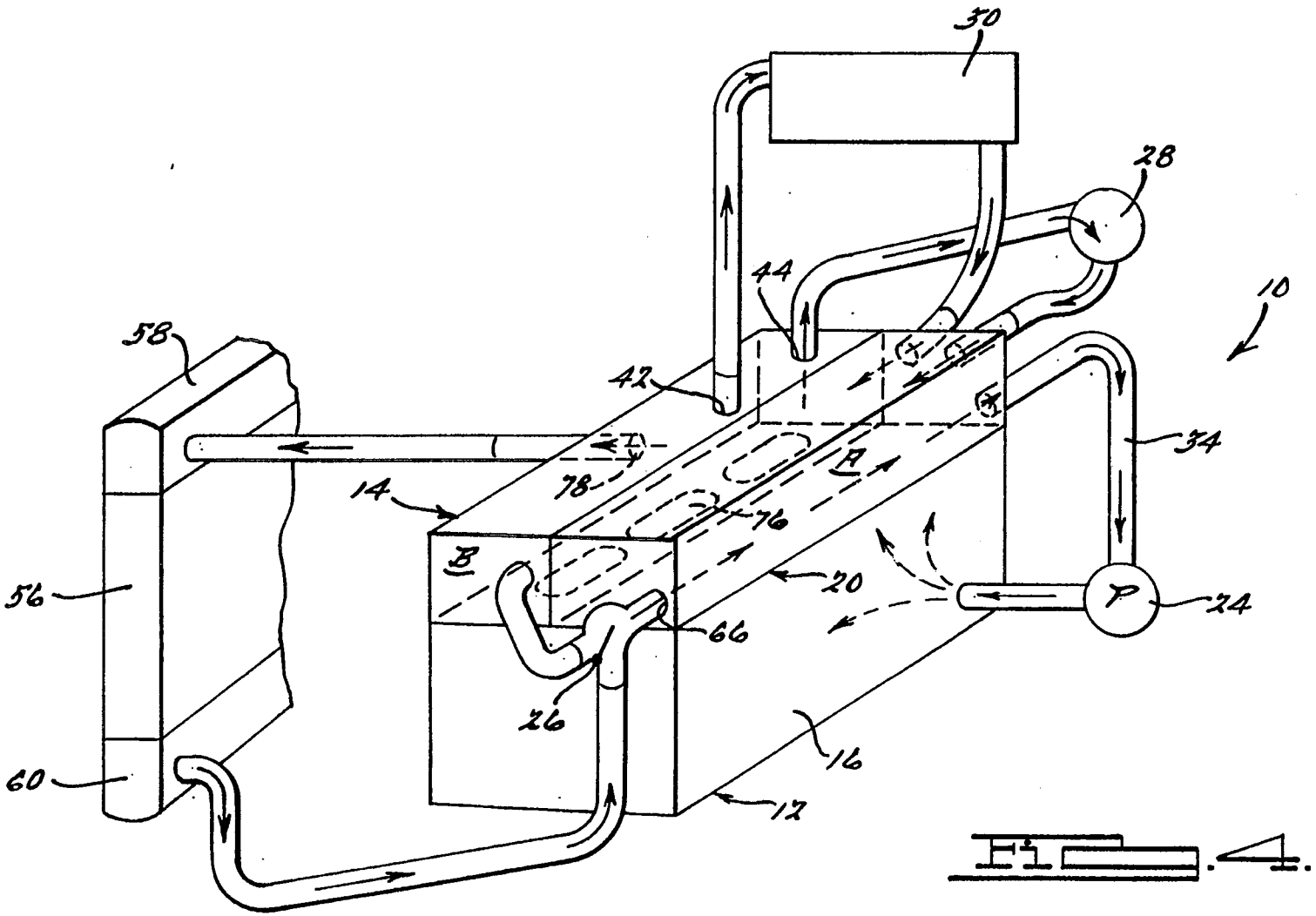
FIG. 4 is still another embodiment of the present invention wherein one segmented region operates substantially free of coolant vapor.

FIG. 4 illustrates yet another construction of the cooling system of the present invention. The engine 10 is substantially the same as the engine described in relation to FIGS. 1 through 3 and, therefore, like reference numerals are used to indicate like elements. More specifically, the engine 10 of FIG. 4 differs from the engine described in FIG. 3 above in that it employs a thermostat 26 setting and a dedicated flow rate that allows for substantial subcooling of all vapor generated with the intake cooling chamber "A." If a temperature value for thermostat 26 is selected which is low enough, typically 180° F. (82.2° C.) and the dedicated flow through the segregated intake chamber "A" is sufficient to distribute and turbulate the coolant throughout chamber "A," the volume of vapor which exists, at all typical engine loads and temperatures, will be kept to a minor fraction of the intake chamber area "A." If the vapor fraction is kept to an acceptable minor fraction of chamber "A," the need for the use of a vapor circuit is eliminated because the combined construction and operating balance of the cylinder had 14, gasket 20, pump 24, thermostat 26, and segregated intake chamber area "A" operating with a predetermined lower coolant temperature and dedicated flow rate and patterns has created a sufficient level of subcooling to perform the condensing function within chamber "A."

The unique construction of this embodiment of the present invention wherein segregation of the intake chamber "A" isolates gases generated in the two chambers "A" and the entire segregated intake chamber "A" operating at a lower temperature level than the temperature level of the exhaust chamber area "B," makes significant subcooling possible.

Generally, the achievement of substantial levels of subcooling can be easily identified by simply observing the volume of vapor which is generated and that exits the chamber "A" at outlet port 32, passes through conduit 34, and enters pump 24. If excessive vapor is seen in that circuit, a measurable loss in coolant flow will be observed and a reduction in coolant temperature setting of thermostat 26 will be required. Alternately, coolant flow must be increased.

With levels of vapor subcooling achieved as available in this embodiment of the present invention, the heater 30 and throttle body heater 28, if used, may be used solely for those single purposes, and connected at points 42 and 44 in the exhaust chamber area "B." Operation of the system illustrated in FIG. 4 will be the same as FIG. 3 from the pump 24 and thereafter with exhaust chamber "B" vapors and gases exiting from the chamber "B" outlet 78, with the coolant thence flowing to the top tank 58 of the radiator 56 where it will rise to the top until reduced to liquid or exhausted to atmosphere.

The pump 24 and thermostat 26 may also be relocated, as described in FIG. 3, to place the pump discharge port where it communicates with the inlet 66 to intake chamber "A" and thereby operate chamber "A" under positive pressure as described in FIG. 2.

During open (hot) thermostat conditions, coolant passes from the radiator 56 through the thermostat 26 into the cylinder head intake chamber half "A" passes through the intake chamber half, and is drawn out of the intake half, at the opposite end, by the coolant pump 24. The coolant pump, after drawing hot coolant from the intake half, forces coolant into the engine block 12, around the cylinders in cylinder block cooling chamber 16, completing the reverse-flow circuit, up through passageways 76 into the exhaust side coolant chamber half of the "B" cylinder head, starting the conventional flow circuit. The coolant passes out of the exhaust chamber half to the top tank 58 of the radiator 56.

The proportioning thermostat 26, when operating in the by-pass position, passes hot coolant from the exhaust half "B" of the cylinder head 14 directly into the intake half "A" of the head 14, whereby it passes through the intake half, into the pump 24, up through the block 12 and back into the exhaust half "B", where it will again return through the thermostat 26 into the intake half "A" as long as the thermostat inlet leg 62 from the radiator remains closed during the by-pass setting.

The passenger heater 30 and throttle body heater 28 circuits are conducted at high points 42 and 44 respectively in the exhaust half "B" coolant chamber and vapor collecting in the upper region of the chamber "B" passes into the heater core 30 or cold throttle body chamber 28 where the vapor condenses. Both circuits return to the low pressure side of the circuit at the coolant pump "draw" side of the head in chamber "A" or in conduit 34.

Employment of the coolant pump 24 to draw hot coolant directly from the engine, in such a manner, with aqueous based coolants in a "draw-through" reverse-flow system allows the use of similar placement of the previously used standard flow parts of a cooling system, namely, by modifying the conventional engine block, pump drive, radiator, mounts and brackets. A new head, thermostat housing, coolant pump, pump manifold, and thermostat pellet are required. Thus, this embodiment of the invention is relatively easy and cost effective, resulting in achieving the major benefits of the invention.

I claim:

1. A process for reducing gases in a reverse-flow cooling system of an internal combustion engine having a heat exchanger, a coolant pump and discrete cooling chambers for the engine cylinder head combustion chamber and engine cylinder block comprising the steps of:

pumping a substantially aqueous, boilable liquid coolant, having a saturation temperature at least equal to water from said pump to the engine cylinder block coolant chamber;

pumping coolant from the cylinder block coolant chamber to a heat exchanger;

pumping coolant from said heat exchanger to the cylinder head coolant chamber;

pumping a first portion of coolant from the cylinder head coolant chamber through a first outlet to a vapor condenser, thence back to a lower coolant pressure area of the cylinder head coolant chamber established by the action of the coolant pump;

returning a second portion of coolant from said cylinder head coolant chamber directly to said pump so as to bypass said vapor condenser, whereby primarily coolant vapor and noncondensible gases residing within the coolant in the combustion chamber coolant chamber are discharged to said vapor condenser and primarily coolant is discharged directly to said pump so as to maintain the volume of coolant vapor and other noncondensible gases as a minor fraction of the total coolant volume in the cylinder head combustion chamber coolant chamber.

2. A process as defined in claim 1 wherein said lower pressure area comprises a return inlet for the first portion of coolant located downstream of the first outlet in said cylinder head coolant chamber.

3. A process as defined in claim 1 wherein said coolant is forced into said cylinder block coolant chamber by positive pressure from said coolant pump.

4. A process as defined in claim 1 wherein coolant is drawn into said cylinder block coolant chamber by a vacuum created by the action of said coolant pump.

5. A process as defined in claim 4 including the step of condensing coolant vapor in a gas condenser circuit having an inlet in fluid communication with the coolant chamber for said combustion chamber and an outlet in communication with an area of the coolant circuit which is at a lower pressure than said inlet.

6. In a reverse-flow cooling system for an internal combustion engine employing an aqueous, boilable liquid coolant having a saturation temperature at least equal to water:

a discrete combustion chamber cooling chamber;

a discrete piston and cylinder bore cooling chamber;

a heat exchanger;

means disposed between said combustion and cylinder cooling chambers for substantially precluding the passage of fluid therebetween but allowing the passage of gas between said chambers;

means for introducing a major portion of coolant from said heat exchanger to said combustion chamber cooling chamber;

a pump for effecting coolant flow from said combustion chamber cooling chamber to said piston and cylinder bore cooling chamber; and means for discharging and condensing gases residing within said combustion chamber coolant chamber whereby the volume of gases in said combustion chamber coolant chamber is maintained at a minor fraction of the total coolant volume therein.

7. In a reverse-flow cooling system for an internal combustion engine comprising an aqueous, boilable liquid coolant having a saturation temperature at least equal to water, a cylinder block cooling chamber;

an exhaust valve cooling chamber;

a discrete intake valve cooling chamber separate from said cylinder block and exhaust valve cooling chambers;

a conduit extending from said exhaust valve cooling chamber to said heat exchanger;

a common return conduit from said heat exchanger to said intake and exhaust valve cooling chambers; and means for dividing the flow of coolant from said heat exchanger to said intake and exhaust valve cooling chambers.

8. A cooling system as defined in claim 7 including a gas condenser circuit having an inlet in fluid communication with the exhaust valve cooling chamber and an outlet in fluid communication with the intake valve cooling chamber.

9. A cooling system in accordance with claim 8 including a second gas condenser circuit having an inlet connected to an outlet in the intake valve cooling chamber and an outlet connected to an inlet in the intake valve cooling chamber located downstream of the outlet therein.

* * * * *